US010611603B2

(12) United States Patent
Kou et al.

(10) Patent No.: US 10,611,603 B2
(45) Date of Patent: Apr. 7, 2020

(54) WIRE ROPE SUSPENSION DEVICE, CONTROL METHOD THEREOF AND MULTI-ROPE FRICTION LIFTER

(71) Applicant: TAIYUAN UNIVERSITY OF TECHNOLOGY, Shanxi (CN)

(72) Inventors: Ziming Kou, Shanxi (CN); Juan Wu, Shanxi (CN); Baofu Kou, Shanxi (CN); Haiqing Wang, Shanxi (CN); Aiming Cheng, Shanxi (CN); Shaokai Kou, Shanxi (CN)

(73) Assignee: TAIYUAN UNIVERSITY OF TECHNOLOGY, Shanxi (CN)

( * ) Notice: Subject to any disclaimer, the term of this patent is extended or adjusted under 35 U.S.C. 154(b) by 0 days.

(21) Appl. No.: 16/340,132

(22) PCT Filed: Mar. 3, 2017

(86) PCT No.: PCT/CN2017/075583

§ 371 (c)(1),
(2) Date: Apr. 7, 2019

(87) PCT Pub. No.: WO2018/157385

PCT Pub. Date: Sep. 7, 2018

(65) Prior Publication Data

US 2019/0241402 A1 Aug. 8, 2019

(51) Int. Cl.

| | |
|---|---|
| ***B66B 7/06*** | (2006.01) |
| ***B66B 11/08*** | (2006.01) |
| ***B66B 7/10*** | (2006.01) |

(52) U.S. Cl.

CPC ..... *B66B 7/06* (2013.01); *B66B 7/10* (2013.01); *B66B 11/08* (2013.01); *D07B 2501/2007* (2013.01)

(58) Field of Classification Search

CPC .. B66B 19/02; B66B 7/08; B66B 7/06; B66B 11/08; B66B 7/10; D07B 2501/2007

See application file for complete search history.

(56) References Cited

U.S. PATENT DOCUMENTS 6,223,862 B1 5/2001 Barnes
9,914,618 B2 * 3/2018 Zhu ..... B66B 7/10

FOREIGN PATENT DOCUMENTS

CN 2510459 9/2002
CN 101759080 6/2010

(Continued)

OTHER PUBLICATIONS

Machine Translation of DE 3823854.*
"International Search Report (Form PCT/ISA/210)", dated Dec. 6, 2017, with English translation thereof, pp. 1-4.

*Primary Examiner* — Diem M Tran
(74) *Attorney, Agent, or Firm* — JCIP Global Inc.

(57) ABSTRACT

The present invention relates to a wire rope suspension device, control method and multi-rope friction lift system, the device comprising: a first beam (6) and a second beam (9) which are passed by a wire rope (1) and fixed to the wire rope (1); a suspension joint (15), for connecting a lifting container (30); a suspension cylinder (14), having two ends respectively connected to the second beam (9) and the suspension joint (15); a wedge joint (8), being disposed in an accommodating chamber provided inside the second beam (9); and a wire rope bias limiting mechanism, being disposed between the wedge joint (8) and the second beam (9), for driving the wedge joint (8) to lock a wire rope section on one side of the wedge joint (8) itself and releasing movement restriction of a wire rope section on the other side of the wedge joint (8), when the second beam (9) has a displace- (Continued)

ment with respect to the first beam (6) in a predetermined direction. The present invention allows a convenient rope adjustment operation.

19 Claims, 5 Drawing Sheets

(56) References Cited

FOREIGN PATENT DOCUMENTS

| | | | | | |
|---|---|---|---|---|---|
| CN | 103183268 | | 8/2016 | | |
| CN | 205590136 | | 9/2016 | | |
| DE | 3823854 | A1 * | 2/1989 | ..... | B66B 7/08 |
| JP | 2011079639 | | 4/2011 | | |
| JP | 2012096907 | A * | 5/2012 | | |
| WO | WO-2006126276 | A1 * | 11/2006 | ..... | B66B 7/08 |

* cited by examiner

WIRE ROPE SUSPENSION DEVICE, CONTROL METHOD THEREOF AND MULTI-ROPE FRICTION LIFTER

CROSS-REFERENCE TO RELATED APPLICATION

This application is a 371 of international application of PCT application serial no. PCT/CN2017/075583, filed on Mar. 3, 2017. The entirety of the above-mentioned patent application is hereby incorporated by reference herein and made a part of this specification.

FIELD OF THE INVENTION

The present invention relates to the field of engineering work, and in particular to a wire rope suspension device, a control method and a multi-rope friction lifting system.

BACKGROUND OF THE INVENTION

For a mine lifter, a wire rope suspension device is an important device for the normal operation of the lifter. An existing wire rope suspension device having a peach-shape ring can realize the function of locking the wire rope, as well as the function of automatically balancing the wire rope by adjusting the tension of the wire rope. However, such a device can not realize the rope adjustment function by itself, and a special rope adjusting equipment is needed to adjust the rope. The peach-shape ring needs to be opened when the rope is adjusted, and to be closed after adjustment of the rope is completed, such that the rope adjustment takes long time and its cost is high.

On the other hand, an insufficient attention has been paid to the release of the torsional moment of the wire rope of an existing wire rope suspension device. As a mine depth increases, alternating fatigue stress a wire rope will increase and service life of the wire rope will be then shortened rapidly. In terms of control method, an existing wire rope suspension device having a peach-shape ring excessively relies on a cylinder in automatically balancing the wire rope by adjusting a tension thereof such that adjustment of the rope has to be performed after a piston rod of the cylinder has completed its stroke. When a wire rope is tensioned, it will have plastic deformation, and especially its deformation is great for the wire rope in a kilometer deep well. However, a short cylinder stroke leads to a short period for rope adjustment, which increases labor costs.

SUMMARY OF THE INVENTION

The present invention has an object to provide a wire rope suspension device, control method and multi-rope friction lifting system, capable of performing a rope adjustment operation conveniently.

In order to achieve the above object, the present invention provides a wire rope suspension device including: a first beam and a second beam which are provided to be passed through by a wire rope, so that the wire rope can be fixed; a suspension joint, for connecting a lifting container; a suspension cylinder, having two ends respectively connected to the second beam and the suspension joint; a wedge joint, being disposed in an accommodating chamber provided inside the second beam; and a wire rope bias limiting mechanism, being disposed between the wedge joint and the second beam, for driving the wedge joint to lock a wire rope section on one side of the wedge joint itself and releasing movement restriction of a wire rope section on the other side of the wedge joint, when the second beam has a displacement with respect to the first beam in a predetermined direction.

In some embodiments, the wire rope bias limiting mechanism is configured to drive the wedge joint to move biasedly to a side wall of the accommodating chamber for locking a wire rope section on a first side of the wedge joint and releasing movement restriction of a wire rope section on a second side of the wedge joint, when the second beam is displaced toward the first beam; and the wire rope bias limiting mechanism is configured to drive the wedge joint to move biasedly to a side wall of the accommodating chamber for locking the wire rope section on the second side of the wedge joint and releasing movement restriction of the wire rope section on the first side of the wedge joint, when the second beam is displaced backward the first beam.

In some embodiments, a side plate is provided on the second beam, the second beam is connected to the suspension cylinder through the side plate; and the wire rope bias limiting mechanism includes: a first locking top arm and a second locking top arm, both having one end hinged to the second beam; and a push-pull member, having one end thereof forming a revolving pair with the other end of the second locking top arm, and the other end thereof forming a sliding pair and a revolving pair respectively with each of the side plate, the wedge joint and the second beam; the first locking top arm being positioned above the second locking top arm and the push-pull member, the side plate, the wedge joint and the second beam being pivotally connected to the first locking top arm through a hinge shaft.

In some embodiments, the wedge joint includes a joint body having a wedge-shaped side surface, sectional dimensions of the joint body gradually increasing from top to bottom, an inner contour of the accommodating chamber matching the side surface of the wedge joint, the wedge joint is configured to be movable laterally and vertically relative to the accommodating chamber, both the side surface and a bottom surface of the joint body being provided with rope grooves, for jointly receiving the passing wire rope together with the inner contour of the accommodating chamber.

In some embodiments, a wire rope self-locking mechanism is provided on the first beam, and the wire rope self-locking mechanism is configured to automatically lock the wire rope entering and/or exiting from the first beam during normal operation process and rope adjustment process of the lifting system.

In some embodiments, the wire rope self-locking mechanism includes a rope entering wedge hole and a rope exiting wedge hole, a rope entering wedge block and a rope exiting wedge block being respectively arranged in the rope entering wedge hole and the rope exiting wedge hole; wherein the wire rope exits from the rope entering wedge hole, bypasses the wedge joint in the second beam and then enters the rope exiting wedge hole, the rope entering wedge block and the rope exiting wedge block automatically locking the entering wire rope respectively, and cross-sectional dimensions of the rope entering wedge hole and cross-sectional dimensions of the rope exiting wedge hole being tapered in a direction opposite to an entering direction of the wire rope.

In some embodiments, a first disc spring and a second disc spring are respectively disposed at wire rope entrances of the rope entering wedge hole and the rope exiting wedge hole.

In some embodiments, the rope entering wedge hole is located at a central position of the first beam.

In some embodiments, an outer bracket is further included, at least partial structures of the first beam, the second beam, the suspension cylinder and the suspension joint are disposed in an inner space of the outer bracket, and a plane bearing is provided between the outer bracket and the first beam, the plane bearing has one surface fixed to the outer bracket and the other surface fixed to the first beam.

In some embodiments, an outer bracket and a joint limiting mechanism are further included, at least partial structures of the first beam, the second beam, the suspension cylinder and the suspension joint are disposed in the inner space of the outer bracket, the joint limiting mechanism is configured to effect switching between a movement restriction state and a movement restriction releasing state of the suspension joint with respect to the outer bracket during operation process.

In some embodiments, the joint limiting mechanism includes a first pin hole and a second pin hole respectively disposed on the outer bracket and the suspension joint, the movement restriction state is effected by inserting a limit pin into the first pin hole and the second pin hole, and the movement restriction releasing state is effected by pulling out the limit pin from the first pin hole and the second pin hole.

In some embodiments, the first beam and the second beam are connected by a screw, and the screw is provided with an adjusting nut, for adjusting and fixing the relative position between the first beam and the second beam.

In some embodiments, oil chambers on both sides of a piston in the suspension cylinder are provided with oil ports, which are configured to connect a pressure oil source upon performing the rope adjustment operation of the wire rope, such that the suspension cylinder extends to push the second beam to move toward the first beam or retracts to pull the second beam to move away from the first beam.

In order to achieve the above object, the present invention provides a multi-rope friction lifting system including: a lifting container; a lifting drive mechanism; a plurality of wire ropes; and a plurality of aforementioned wire rope suspension devices corresponding to the plurality of wire ropes.

In some embodiments, oil ports on rod chambers of individual wire rope suspension devices are communicated with each other through an oil passage, and a control valve is provided at the oil port of each rod chamber, oil ports on rodless chambers of individual wire rope suspension devices are also communicated to each other through an oil passage, and a control valve is provided at the oil port of each rodless chamber.

In order to achieve the above object, the present invention provides a control method based on aforementioned wire rope suspension device, including: a rope exiting process: driving the second beam to displace toward the first beam by the suspension cylinder; and by means of the wire rope bias limiting mechanism, driving the wedge joint to move biasedly to a side wall of the accommodating chamber for locking a wire rope section on a first side of the wedge joint and releasing movement restriction of a wire rope section on a second side of the wedge joint, so as to effect rope exiting of the wire rope; a rope entering process: driving the second beam to displace oppositely with respect to the first beam by the suspension cylinder; and by means of the wire rope bias limiting mechanism, driving the wedge joint to move biasedly to a side wall of the accommodating chamber for locking the wire rope section on the second side of the wedge joint and releasing movement restriction of the wire rope section on the first side of the wedge joint, so as to effect rope entering of the wire rope.

In some embodiments, the wire rope suspension device further includes an outer bracket and a joint limiting mechanism, at least partial structures of the first beam, the second beam, the suspension cylinder and the suspension joint are disposed in the inner space of the outer bracket, the control method further includes: during the rope exiting process, operating the joint limiting mechanism so as to form a movement restriction state between the suspension joint and the outer bracket; during the rope entering process, operating the joint limiting mechanism so as to form a movement restriction releasing state between the suspension joint and the outer bracket.

In some embodiments, the joint limiting mechanism includes a first pin hole and a second pin hole respectively disposed on the outer bracket and the suspension joint, operation of the joint limiting mechanism specifically includes: inserting a limit pin into the first pin hole and the second pin hole to effect the movement restriction state; and pulling out the limit pin from the first pin hole and the second pin hole to effect the movement restriction releasing state.

In some embodiments, the first beam and the second beam are connected by a screw with an adjusting nut provided thereon, the control method further includes: adjusting the adjusting nut to enable a relative movement between the first beam and the second beam before effecting rope adjustment of the wire rope by driving the second beam to move by the suspension cylinder; and adjusting the adjusting nut so as to maintain a fixed position of the first beam relative to the second beam after completion of rope adjustment of the wire rope.

In some embodiments, oil chambers on both sides of a piston in the suspension cylinder are provided with oil ports, the control method further includes: before effecting the rope adjustment of the wire rope by driving the second beam to move by means of the suspension cylinder, connecting the oil ports of the suspension cylinder to a pressure oil source such that the suspension cylinder extends to push the second beam to move toward the first beam or retracts to pull the second beam to move away from the first beam.

Based on the above technical solution, the present invention associates a movement process of the second beam relative to the first beam with a driving action of the wire rope bias limiting mechanism on the wedge joint. When the second beam is displaced in different movement directions with respect to the first beam, the wedge joint is capable of locking the wire rope sections on different sides thereof and releasing the movement restriction of the wire rope section on a non-locking side thereof so as to allow exiting or entering of the wire rope passing through the second beam, relative to the first beam, such that an operator is able to complete adjustment of the wire rope by operating the second beam to move relative to the first beam, thereby simplifying the rope adjusting process of the wire rope. The wire rope suspension device according to the invention eliminates not only the need to disassemble the wedge joint but also the need to use a special rope adjustment device, when it is required to adjust the rope, such that the cost can be saved and the rope adjusting efficiency can be improved.

BRIEF DESCRIPTION OF THE ACCOMPANYING DRAWINGS

The drawings described herein are provided to provide a further understanding of the present invention and constitute a part of the present application. Exemplary embodiments of the present invention and description thereof are intended to interpret the present invention, which do not constitute inappropriate limitation over the present invention. In the drawings.

DETAILED DESCRIPTION OF THE PREFERRED EMBODIMENTS

The technical solutions of the present invention are further described in detail below with reference to the accompanying drawings and embodiments.

Figure 1:
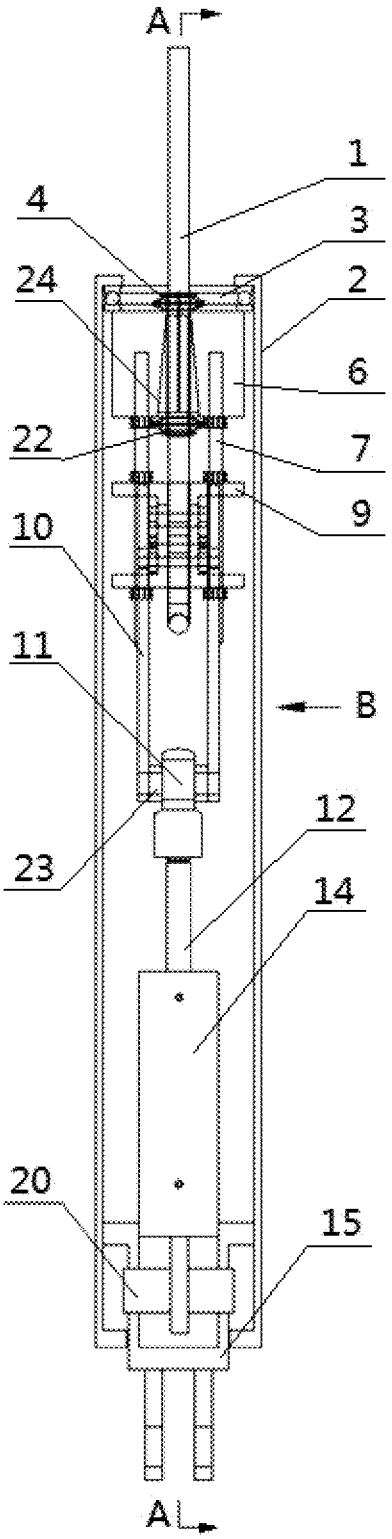
FIG. 1 is a schematic structural view of some embodiments of a wire rope suspension device according to the present invention.
Figure 2:
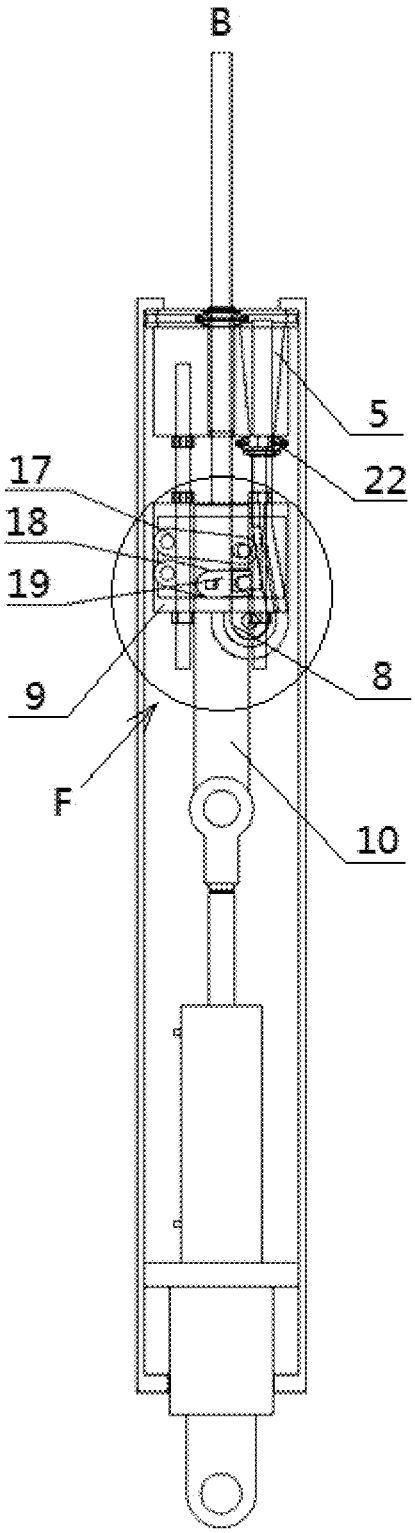
FIG. 2 is a schematic structural view in a B direction in the embodiments of FIG. 1.

FIG. 1 shows a schematic structural view of some embodiments of a wire rope suspension device according to the present invention. Referring to FIG. 1 and FIGS. 2-5, the wire rope suspension device in the present embodiments include a first beam 6, a second beam 9, a suspension cylinder 14 and a suspension joint 15. The first beam 6 and the second beam 9 which are provided to be passed through by a wire rope 1, so that the wire rope 1 can be fixed. Both ends of the suspension cylinder 14 are respectively connected with the second beam 9 and the suspension joint 15.

Figure 9:
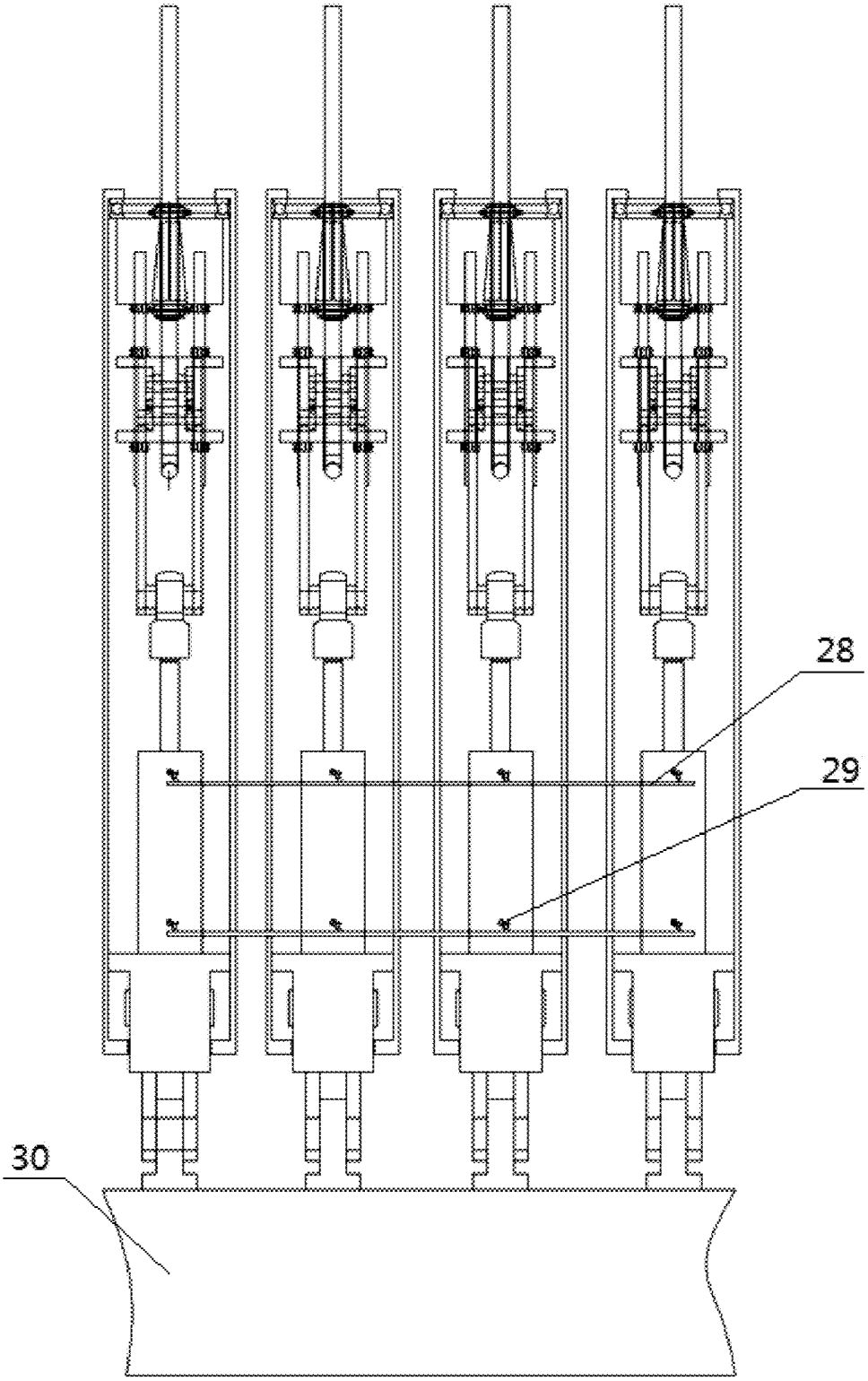
FIG. 9 is a schematic structural view of a multi-rope friction lifter having a plurality of wire rope suspension devices according to the present invention.

When installing the wire rope 1, the wire rope 1 can pass through the first beam 6 and the second beam 9 successively, and then pass out through the second beam 9 and the first beam 6 in an opposite direction. The first beam 6 and the second beam 9 can be connected by a screw 7, and with the screw 7 is provided with an adjusting nut 16, for adjusting and fixing the relative position between the first beam 6 and the second beam 9. The suspension cylinder 14 is connected between the second beam 9 and the suspension joint 15 and may be connected with the second beam 9 directly or indirectly with another intermediate element (for example, a side plate 10 as in FIG. 1 or the like). A piston rod 12 of the suspension cylinder 14 can be connected to the suspension joint 15 via an ear plate 11 and a pin 23. Via a pin 20, the suspension joint 15 can be connected to a lifting container 30 (see FIG. 9), which is a lifting compartment for lifting persons or articles. Oil chambers on both sides of a piston 13 in the suspension cylinder 14 are provided with oil ports, which are configured to connect a pressure oil source during the rope adjustment operation of the wire rope 1 such that the suspension cylinder 14 extends entirely to push the second beam 9 to move in a direction to approach the first beam 6 or that the suspension cylinder 14 retracts entirely to pull the second beam 9 to move away from the first beam 6.

In the present embodiments, the wire rope suspension device further includes a wedge joint 8 and a wire rope bias limiting mechanism. The wedge joint 8 is disposed in an accommodating chamber provided inside the second beam 9, and the wire rope 1 passes through the accommodating chamber and bypasses the wedge joint 8 when passing through the second beam 9 twice. The wire rope bias limiting mechanism is disposed between said wedge joint 8 and said second beam 9 and configured to drive the wedge joint 8 to lock a wire rope section on its one side of the wedge joint 8 itself and releasing movement restriction of a wire rope section on the other side of the wedge joint 8, when the second beam 9 has a displacement with respect to said first beam in a predetermined direction.

In other words, in the present embodiments, a movement process of the second beam relative to the first beam is associated with a driving action of the wire rope bias limiting mechanism on the wedge joint, such that when the second beam is displaced in different movement directions with respect to the first beam, the wedge joint locks the wire rope sections on different sides thereof and releases the movement restriction of the wire rope section on a non-locking side thereof so as to allow exiting or entering of the wire rope passing through the second beam, relative to the first beam. This enables an operator to complete adjustment of the wire rope by operating the second beam to move relative to the first beam, thereby simplifying the rope adjusting process of the wire rope. As compared to the existing wire rope adjustment manner, the present embodiments eliminate not only the need to disassemble the wedge joint but also the need to use a special rope adjustment device, when it is required to adjust the rope, such that the cost can be saved and the rope adjusting efficiency can be improved.

Figure 3:
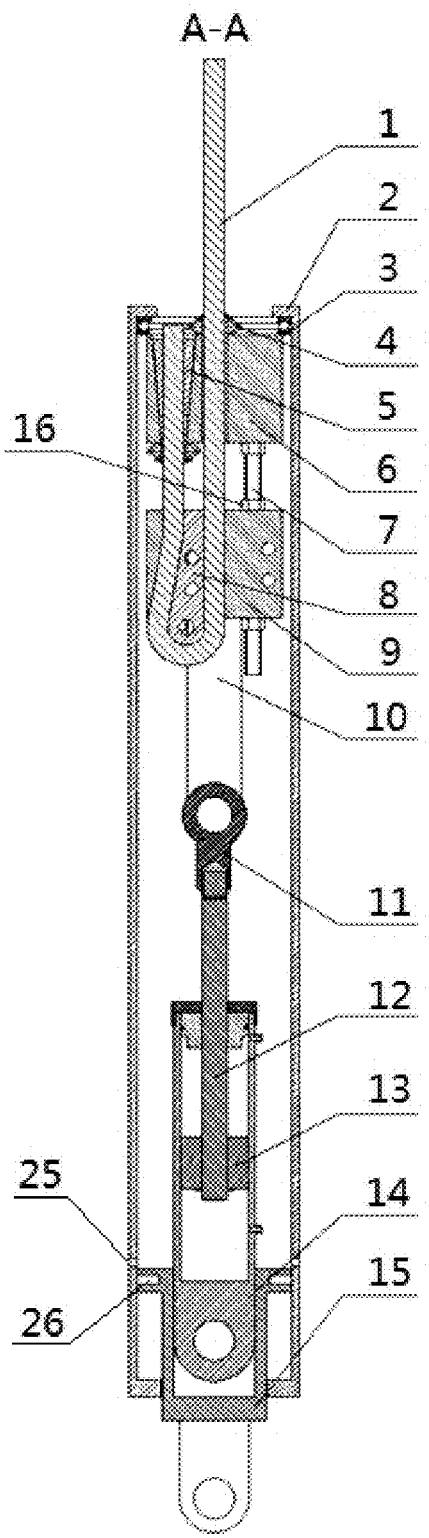
FIG. 3 is a schematic cross-sectional view taken along line A-A in the embodiments of FIG. 1.

In FIG. 3, said wire rope bias limiting mechanism is configured to drive said wedge joint 8 to move biasedly to a side wall of the accommodating chamber for locking a wire rope section on a first side (the left side of the wedge joint 8 in FIG. 3) of the wedge joint 8 and releasing movement restriction of a wire rope section on a second side (the right side of the wedge joint 8 in FIG. 3) of the wedge joint 8, when said second beam 9 is displaced toward said first beam 6. Here, as movement of the wire rope section on the first side is restricted, when the second beam 9 moves upward, the wire rope section on the first side may exit upward from the first beam 6 to effect a rope exiting process of the wire rope 1.

Said wire rope bias limiting mechanism is configured to drive said wedge joint 8 to move to a side wall of the accommodating chamber for locking the wire rope section on the second side of the wedge joint 8 and releasing movement restriction of the wire rope section on the first side of the wedge joint 8, when said second beam 9 is oppositely displaced relative to said first beam 6. Here, as movement of the wire rope section on the second side is restricted, when the second beam 9 moves downward, the wire rope section on the second side may be pulled out downwardly to effect a rope entering process of the wire rope 1.

The movement process of the second beam relative to the first beam may be associated with the driving action of the wire rope bias limiting mechanism on the wedge joint by a variety of manners (for example, through an electronic control linkage manner, a timing linkage manner, a mechanical linkage manner or the like). For example, a sensor may be provided to detect a movement process of the second beam relative to the first beam and transmit it to a controller.

The controller can control the wire rope bias limiting mechanism to drive the wedge joint to lock the wire rope sections on different sides of the wedge joint itself according to the sensing signal and release the movement restriction of the wire rope section on the non-locking side. In other examples, the controller may be used to simultaneously control the timing linkage of the movement of the second beam relative to the first beam and the drive of the wedge joint by the wire rope bias limiting mechanism.

Figure 5:
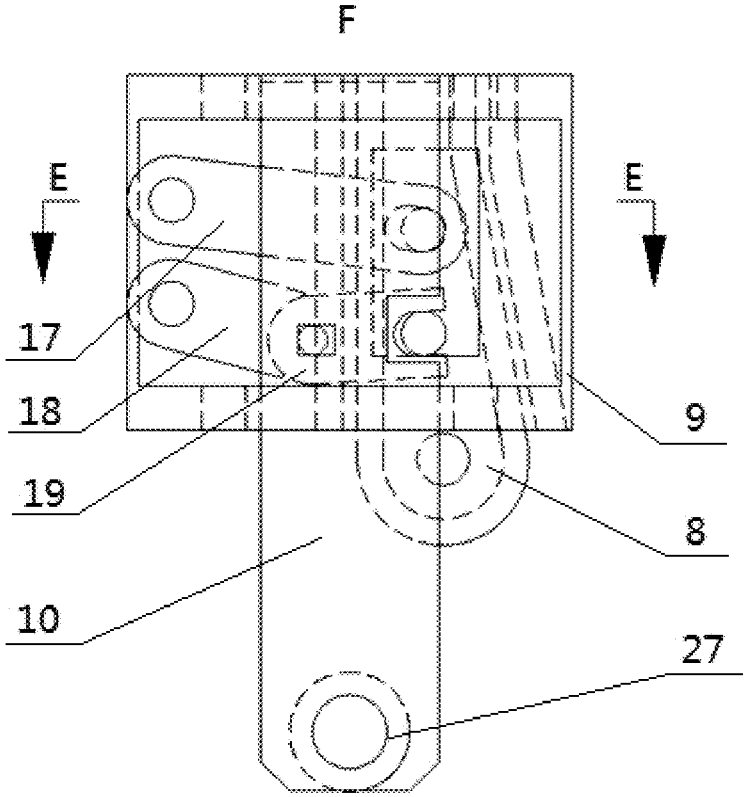
FIG. 5 is an enlarged schematic view of an area F in FIG. 2.

FIG. 5 shows an example of a mechanical linkage manner. A movement of the second beam is capable of actuating the wire rope bias limiting mechanism in the manner of a mechanical linkage to drive the wedge joint to lock the wire rope sections on different sides of the wedge joint and release the movement restriction of the wire rope section on the non-locking side. In particular, a side plate 10 is provided on the second beam 9, the second beam 9 is connected to the suspension cylinder 14 via the side plate 10, and the side plate 10 is configured to move in a vertical direction with respect to the second beam 9. The wire rope bias limiting mechanism specifically includes: a first locking top arm 17, a second locking top arm 18 and a push-pull member 19. The first locking top arm 17 is positioned above the second locking top arm 18 and the push-pull member 19. One end of the first locking top arm 17 and one end of the second locking top arm 18 are hinged to the second beam 9. The side plate 10, the wedge joint 8 and the second beam 9 form a pivotal pair with the first locking top arm 17 through a hinge shaft. The push-pull member 19 has one end thereof pivotally connected to the other end of the second locking top arm 18, and the other end thereof forming a sliding pair and a revolving pair respectively with each of the side plate 10, the wedge joint 8 and the second beam 9.

When the side plate 10 is pushed up by the suspension cylinder 14, the side plate 10 can push the second locking top arm 18 to rotate counterclockwise while the push-pull member 19 rotates clockwise and pushes the wedge joint 8 to a right side until a wire rope section on the right side of the wedge joint 8 is compressed tightly such that the wire rope section on the right side is not movable relative to the second beam 9. Meanwhile, the wire rope section on the left side of the wedge joint 8 is released and is movable relative to the second beam 9. With the upward movement of the side plate 10, the second beam 9 is also driven to move upward. The second beam 9 will drive the compressed wire rope section to exit upward from the first beam 6 while the remaining rope on the rope entering side of the first beam 6 slides to a lower side of the second beam 9 to thereby complete the rope exiting process.

When the rope exiting process is completed, the suspension cylinder 14 can pull the side plate 10 to move downward, and the side plate 10 can drive the second locking top arm 18 to rotate clockwise while the push-pull member 19 rotates counterclockwise such that the wire rope section on the right side of the wedge joint 8 is released. The downward movement of the side plate 10 will drive the first locking top arm 17 to rotate clockwise until a wire rope section on the left side of the wedge joint 8 is compressed tightly such that the wire rope section on the left side is not movable relative to the second beam 9. With the downward movement of the side plate 10, the second beam 9 is also driven to move downward, whereby the compressed wire rope section on the left side of the wedge joint 8 moves downward along with the second beam 9 to pull out a wire rope section from the first beam 6 such that the remaining rope on the rope exiting side of the first beam 6 is replaced by the pulled wire rope section which is closely attached to the wedge joint 8 to thereby complete the rope entering process.

In order to enable the wedge joint 8 to achieve accurately and effectively the effect on the wire rope 1 in the rope adjustment process as described above, the wedge joint 8 preferably includes a joint body with a wedge-shaped side surface. The joint body has sectional dimensions gradually increasing from top to bottom. An inner contour of the accommodating chamber is wedge-shaped and matches the side surface of the joint body of the wedge joint 8. Both the side surface and a bottom surface of the joint body are provided with rope grooves, which can jointly accommodate the passing wire rope 1 with the inner contour of the accommodating chamber. The wedge joint 8 is movable laterally and vertically relative to the accommodating chamber. Along with the lateral movement of the wedge joint 8, the wire rope 1 on the side surface of the wedge joint 8 can be compressed or released.

Figure 6:
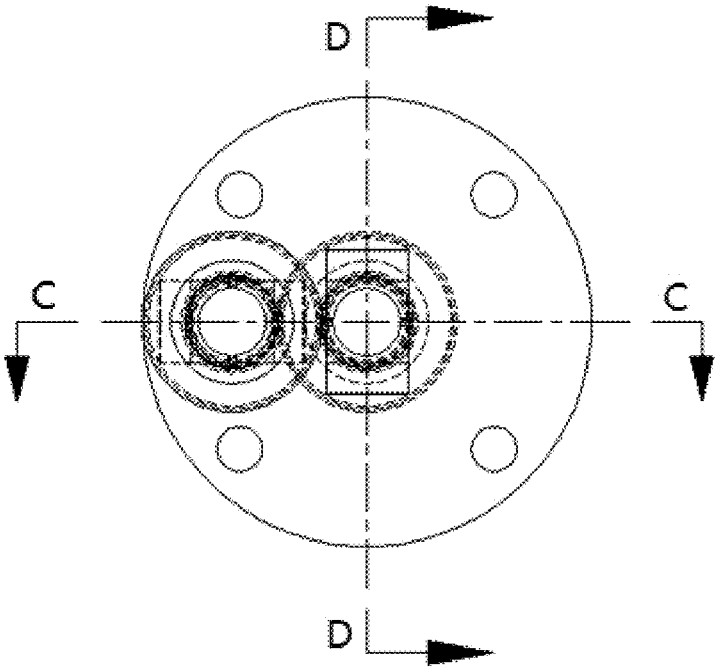
FIG. 6 is a top view of a first beam related structure of some embodiments of a wire rope suspension device according to the present invention.
Figure 7:
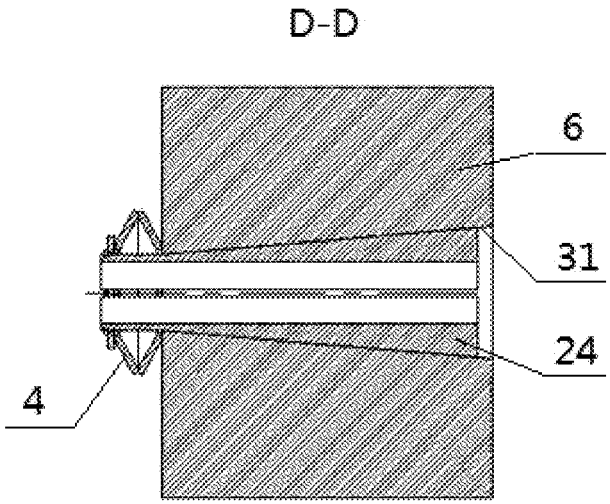
FIG. 7 is a schematic cross-sectional view taken along line D-D of the first beam related structure in FIG. 6.
Figure 8:
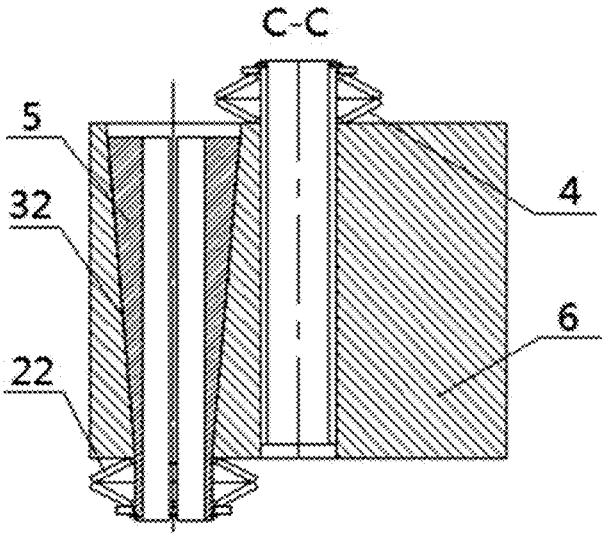
FIG. 8 is a schematic cross-sectional view taken along line C-C of the first beam related structure in FIG. 6.

In order to ensure that no slippage occurs between the wire rope suspension device and the wire rope 1, a wire rope self-locking mechanism can be provided in the first beam 6 to enable automatic locking of the rope entering and/or exiting of the wire rope 1 with respect to the first beam 6. FIG. 6 shows a top view of a first beam related structure of some embodiments of a wire rope suspension device according to the present invention. Referring to the two sectional views as shown in FIGS. 7 and 8, the wire rope self-locking mechanism includes a rope entering wedge hole 31 and a rope exiting wedge hole 32. A rope entering wedge block 24 and a rope exiting wedge block 5 are respectively arranged in the rope entering wedge hole 31 and the rope exiting wedge hole 32. The wire rope 1 exits from the rope entering wedge hole 31, bypasses the wedge joint 8 in the second beam 9 and then enters the rope exiting wedge hole 32. The rope entering wedge block 24 and the rope exiting wedge block 5 automatically lock the entering wire rope 1 respectively. Cross-sectional dimensions of the rope entering wedge hole 31 and of the rope exiting wedge hole 32 are tapered in a direction opposite to an entering direction of the wire rope 1.

During normal operation, the wire rope 1 tends to be pulled out relative to the first beam 6. During the action of the rope entering wedge block 24 and the rope entering wedge hole 31, the more the wire rope 1 is pulled out, the closer the rope entering wedge block 24 will compress the wire rope 1 and the greater pressure is imposed on it to form a greater frictional force so as to prevent the wire rope 1 from being pulled upward, and conversely, the wire rope 1 can smoothly enter a gap formed by the rope entering rope wedge block 24. Thus, a safe structure allowing only entering but no exiting of the wire rope is formed. Similarly, an end of the wire rope 1 extends into the rope exiting wedge hole 32 of the first beam 6 via the second beam 9, and realizes the locking effect by the rope exiting wedge block 5. When the wire rope 1 is pulled outward, the rope exiting wedge block 5 and the rope exiting wedge hole 32 can cooperate to clamp the end of the wire rope 1 so as to prevent the end of the wire rope 1 from being pulled down into the first beam 6. Conversely, the wire rope 1 can exit upward smoothly with respect to the first beam 6. Thus, a safe structure allowing only exiting but no entering of the wire rope is formed.

The wire rope self-locking mechanism can not only ensure the safety of the wire rope suspension to avoid slippage of the wire rope with respect to the wire rope suspension device, but also realize the wire rope adjusting function in coordination with the wedge joint 8 and the wire rope bias limiting mechanism. Thus, systematicness, reliability and practicability of the entire device are improved.

The rope entering wedge hole 31 is preferably located at a central position of the first beam 6 to ensure a balance of tension between the wire rope and the wire rope suspension device. A first disc spring 4 and a second disc spring 22 are respectively disposed at wire rope passing ports of the rope entering wedge hole 31 and the rope exiting wedge hole 32. The first disc spring 4 has an end fixed to a smaller dimension section of the rope entering wedge block 24 and another end mounted tightly on an upper surface of the first beam 6. The second disc spring 22 has an end fixed to a smaller dimension section of the rope exiting wedge block 5 and another end mounted tightly on a lower surface of the first beam 6. The main function of the first disc spring 4 and the second disc spring 22 is to lock the wire rope during normal operation process of a lifting system and to play the role of locking the wire rope in unidirectional rope entering at the rope entering port and unidirectional rope exiting at the rope exiting port during the rope adjusting process.

In FIGS. 1-4, the wire rope suspension device may further include an outer bracket 2. At least partial structures of the first beam 6, the second beam 9, the suspension cylinder 14 and the suspension joint 15 are disposed in an inner space of the outer bracket. A plane bearing 3 is provided between the outer bracket 2 and the first beam 6. The plane bearing 3 has one surface fixed to the outer bracket 2 and the other surface fixed to the first beam 6. The plane bearing provided on the first beam 6 enables the release of the torsional moment of the wire rope 1 along with rotation of the wire rope 1.

Figure 4:
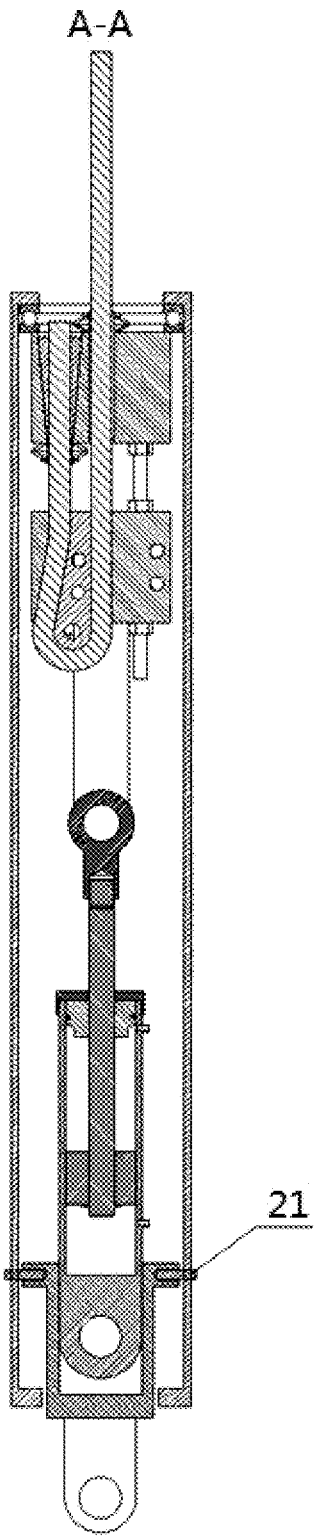
FIG. 4 is a schematic cross-sectional view taken along line A-A in the embodiments of FIG. 1 in which the outer bracket and the suspension joint are fixed by the limit pin.

In other embodiments, the wire rope suspension device may further include a joint limiting mechanism. The joint limiting mechanism can be operative to effect switching between a movement restriction state and a movement restriction releasing state of the suspension joint 15 with respect to the outer bracket 2. For example, the joint limiting mechanism as shown in FIGS. 3 and 4 includes a first pin hole 25 and a second pin hole 26 respectively disposed on the outer bracket 2 and the suspension joint 15, the movement restriction state being effected by inserting a limiting pin 21 into the first pin hole 25 and the second pin hole 26, and the movement restriction releasing state being effected by pulling out the limiting pin 21 from the first pin hole 25 and the second pin hole 26.

The above embodiments of the wire rope suspension device of the present invention can be applied to various occasions where a wire rope needs to be suspended, and be particularly suitable for a multi-rope friction lifter. The present invention further provides a multi-rope friction lifter including a lifting container 30, a lifting drive mechanism, a plurality of wire ropes 1, and a plurality of aforementioned wire rope suspension devices corresponding to the plurality of wire ropes. The lifting drive mechanism may include a lifting drum, a lifting cylinder or the like.

Oil ports on rod chambers of individual wire rope suspension devices are communicated with each other through an oil passage 28, and a control valve 29 is provided at the oil port of each rod chamber. Oil ports on rodless chambers of individual wire rope suspension devices are also communicated to each other through an oil passage 28, and a control valve 29 is provided at the oil port of each rodless chamber. The oil passage 28 is able to adjust the tension balance of the wire rope automatically by means of the internal oil pressure balance of each suspension cylinder during normal operation process of the wire rope suspension device. Besides, the oil ports are connectable to a pressure oil source during the rope adjustment process. The pressure oil source may include a hydraulic pump station, an accumulator or any other hydraulic circuit.

Based on each embodiment of said wire rope suspension devices, the present invention also provides a control method, the method includes:

a rope exiting process: driving the second beam 9 to displace toward the first beam 6 by the suspension cylinder 14; and by means of the wire rope bias limiting mechanism, driving the wedge joint 8 to move biasedly to a side wall of the accommodating chamber for locking a wire rope section on a first side of the wedge joint 8 and releasing movement restriction of a wire rope section on a second side of the wedge joint 8, so as to effect exiting of the wire rope 1;

a rope entering process: driving the second beam 9 to displace oppositely with respect to the first beam 6 by the suspension cylinder 14; and by means of the wire rope bias limiting mechanism, driving the wedge joint 8 to move biasedly to a side wall of the accommodating chamber for locking the wire rope section on the second side of the wedge joint 8 and releasing movement restriction of the wire rope section on the first side of the wedge joint 8, so as to effect rope entering of the wire rope 1.

In some embodiments of a wire rope suspension device, the wire rope suspension device further includes an outer bracket 2 and a joint limiting mechanism, at least partial structures of the first beam 6, the second beam 9, the suspension cylinder 14 and the suspension joint 15 are disposed in an inner space of the outer bracket 2, the corresponding control method further includes: during the rope exiting process, operating the joint limiting mechanism so as to form a movement restriction state between the suspension joint 15 and the outer bracket 2; and during the rope entering process, operating the joint limiting mechanism so as to form a movement restriction releasing state between the suspension joint 15 and the outer bracket 2.

In some other embodiments of a wire rope suspension device, the joint limiting mechanism of the wire rope suspension device may include a first pin hole 25 and a second pin hole 26 respectively disposed on the outer bracket 2 and the suspension joint 15, the corresponding operation of the joint limiting mechanism includes: inserting a limiting pin 21 into the first pin hole 25 and the second pin hole 26 to effect the movement restriction state, and pulling out the limiting pin 21 from the first pin hole 25 and the second pin hole 26 to effect the movement restriction releasing state.

In some further embodiments of a wire rope suspension device, the first beam 6 and the second beam 9 of the wire rope suspension device can be connected by a screw 7 with an adjusting nut 16 provided thereon; the corresponding control method further includes: screwing a lower adjusting nut 16 between the first beam 6 and the second beam 9 to a side close to the first beam 6 before driving a movement of the second beam 9 by the suspension cylinder 14 to perform the rope adjustment such that the beam 6 and the second beam 9 is movable toward each other; and after the rope adjustment is completed, screwing the adjusting nut 16 to a side close to the second beam 9 such that the first beam 6 and the second beam 9 maintain a fixed position relationship therebetween.

In some further embodiments of a wire rope suspension device, oil chambers on both sides of a piston 13 in the suspension cylinder 14 are provided with oil ports; the control method further includes: connecting the oil ports of the suspension cylinder 14 to a pressure oil source before driving a movement of the second beam 9 by the suspension cylinder 14 to perform the rope adjustment such that the suspension cylinder extends to push the second beam 9 to move in a direction to approach the first beam 6 or that the suspension cylinder 14 retracts to pull the second beam 9 to move away from the first beam 6.

The normal operational process and the rope adjustment process of the wire rope suspension device will be described in detail below with reference to the structure of the wire rope suspension device shown in FIGS. 1-4.

During the normal operation process of the wire rope suspension device, the wire rope 1, the outer bracket 2, the plane bearing 3, the first beam 6 and the second beam 9 are relatively fixed, the suspension cylinder 14, the suspension joint 15 and the lifting container 30 are relatively fixed. The rod chambers of each suspension cylinder 14 are respectively communicated with each other through the oil passage 28. The rodless chambers are respectively communicated with each other through the other oil passage 28. The control valve 29 on the oil port of the rod chamber is fully open to realize an oil pressure balance among the rod chambers of each cylinder so as to achieve a tension balance of the wire rope.

A rope entering wedge block 24 and a rope exiting wedge block 5 are provided in the first beam 6 to effect automatic locking of the wire rope 1, and the setting direction of the rope entering wedge block 24 and the rope exiting wedge block 5 are opposite. Tightening respectively a plurality of adjusting nuts 16 to positions close to the first beam 6 and the second beam 9, and there is no relative movement between the first beam 6 and the second beam 9.

When the wire rope needs to be adjusted, the operator can insert the limiting pin 21 into the first pin hole 25 on the outer bracket 2 and the second pin hole 26 on the suspension joint 15 such that the outer bracket 2, an upper surface of the plane bearing 4, the suspension cylinder 14, the suspension joint 15 and the lifting container 30 are relatively fixed, and the wire rope 1 and a lower surface of the plane bearing 4, the first beam 6 and the second beam 9 are relatively fixed. Then, the lower adjusting nut 16 which is lower between the first beam 6 and the second beam 9 is screwed to a side close to the first beam 6, and the second beam 9 and the first beam 6 are allowed to move relative to each other. A hydraulic pipeline connected to the oil ports of the suspension cylinder 14 of the wire rope suspension device of which the wire rope needs to be adjusted is disconnected and is respectively connected to ports A and B of the pressure oil source.

The rodless chamber of the suspension cylinder 14 is filled with the pressure oil through the pressure oil source and the rod chamber thereof is unloaded, such that the piston rod 12 moves upward, and drives the side plate 10 to move upward. The side plate 10 drives the wedge joint 8 through the first locking top arm 17, the second locking top arm 18 and the push-pull member 19, to push tightly against a wire rope section on a left side of the wedge joint 8. The side plate 10 drives the second beam 9 to move upward, the wire rope 1 exits upward from the first beam 6, the left rope is not movable, and the remaining rope on the right side is on a lower side of the wedge joint 8, to thereby complete the rope exiting process of the wire rope 1.

After completing the rope exiting process, the pressure oil source can act by means of a reversing valve to fill the rod chamber of the suspension cylinder 14 and to unload the rodless chamber thereof such that the piston rod 12 retracts downward to drive the side plate 10 to move downward. The side plate 10 drives the wedge joint 8 through the first locking top arm 17, the second locking top arm 18 and the push-pull member 19, to push tightly against a wire rope section on the right side of the wedge joint 8. The side plate 10 drives the second beam 9 to move downward, the wire rope 1 is pulled downward from the first beam 6. The remaining rope during the rope exiting process is replaced by a pulled-in rope section and lies against the wedge joint 8, to thereby complete the rope entering process of the wire rope 1.

The above relates to completion of a cycle of rope adjustment process, and a rope adjustment process of a determined length of a rope can be completed by a number of the cycles. After completing the rope adjustment, the adjusting nut 16 is screwed to a side close to the second beam 9 to disconnect the pressure oil source from the oil port of the suspension cylinder 14 and the oil passage 28 between the suspension cylinders 14 is reconnected, and then, the limiting pin 21 that fixes the suspension joint 15 to the outer bracket 2, is pulled out, such that the wire rope suspension device can be restored to its normal working state.

For the embodiments of the wire rope suspension device according to the invention, which includes a wedge joint, a wire rope self-locking mechanism and a wire rope bias limiting mechanism, the wire rope locking is realized through a wire rope self-locking mechanism. During the operation process of the lifting system, a number of suspension cylinders are connected with a hydraulic pipeline to achieve dynamic tension balance of the wire rope; at the same time, torsional moment of the wire rope is released by means of a plane bearing and a pivotal pair. During the process of an overhaul, if the rope exiting is needed, the cylinder is to be communicated with such a pressure oil source as a hydraulic pump station and a control system, as driven by the cylinder, the wire rope bias limiting mechanism moves to effect the rope exiting in cooperation with the wedge joint and wire rope self-locking mechanism, without any further special rope locking and rope adjusting devices.

Finally, it should be noted that, all the above embodiments are only intended to describe technical solutions of the present invention, rather than to limit the same. Although a detailed description is given to the present invention with reference to preferred embodiments, a person skilled in the art should understand that, modifications or equivalent replacements may be made to the technical solutions according to the present invention, so far as such modifications or equivalent replacements do not go away from the substance and scope of the technical solutions according to the present invention.

What is claimed is:

1. A wire rope suspension device, comprising:

a first beam and a second beam which are provided to be passed through by a wire rope so as to fix the wire rope;

a suspension joint, for connecting a lifting container;

a suspension cylinder, having two ends respectively connected to the second beam and the suspension joint;

a wedge joint, being disposed in an accommodating chamber provided inside the second beam; and a wire rope bias limiting mechanism, being disposed between the wedge joint and the second beam, for driving the wedge joint to lock a wire rope section on one side of the wedge joint itself and releasing movement restriction of a wire rope section on the other side of the wedge joint, when the second beam has a displacement with respect to the first beam in a predetermined direction, wherein the wire rope bias limiting mechanism is configured to drive the wedge joint to move biasedly to a side wall of the accommodating chamber for locking the wire rope section on a first side of the wedge joint and releasing movement restriction of the wire rope section on a second side of the wedge join, when the second beam is displaced toward the first beam; and the wire rope bias limiting mechanism is configured to drive the wedge joint to move biasedly to a side wall of the accommodating chamber for locking the wire rope section on the second side of the wedge joint and releasing movement restriction of the wire rope section on the first side of the wedge joint, when the second beam is displaced backward the first beam.

2. The wire rope suspension device according to claim 1, wherein a side plate is provided on the second beam, the second beam being connected to the suspension cylinder through the side plate; and the wire rope bias limiting mechanism comprising:

a first locking top arm and a second locking top arm, both having one end hinged to the second beam; and a push-pull member, having one end thereof forming a revolving pair with the other end of the second locking top arm, and the other end thereof forming a sliding pair and a revolving pair respectively with each of the side plate, the wedge joint and the second beam;

wherein the first locking top arm is positioned above the second locking top arm and the push-pull member, the side plate, the wedge joint and the second beam being pivotally connected to the first locking top arm through a hinge shaft.

3. The wire rope suspension device according to claim 1, wherein the wedge joint comprises a joint body having a wedge-shaped side surface, sectional dimensions of the joint body gradually increase from top to bottom, an inner contour of the accommodating chamber matches the side surface of the wedge joint, the wedge joint is configured to be movable laterally and vertically relative to the accommodating chamber, both the side surface and a bottom surface of the joint body being provided with rope grooves, for jointly receiving the passing wire rope together with the inner contour of the accommodating chamber.

4. The wire rope suspension device according to claim 1, wherein a wire rope self-locking mechanism is provided on the first beam, and the wire rope self-locking mechanism is configured to automatically lock the wire rope entering and/or exiting from the first beam during normal operation process and rope adjustment process of the lifting system.

5. The wire rope suspension device according to claim 4, wherein the wire rope self-locking mechanism comprises a rope entering wedge hole and a rope exiting wedge hole, a rope entering wedge block and a rope exiting wedge block being respectively arranged in the rope entering wedge hole and the rope exiting wedge hole;

wherein the wire rope exits from the rope entering wedge hole, bypasses the wedge joint in the second beam and then enters the rope exiting wedge hole, the rope entering wedge block and the rope exiting wedge block automatically locking the entering wire rope respectively, and cross-sectional dimensions of the rope entering wedge hole and cross-sectional dimensions of the rope exiting wedge hole being tapered in a direction opposite to an entering direction of the wire rope.

6. The wire rope suspension device according to claim 5, wherein a first disc spring and a second disc spring are respectively disposed at wire rope entrances of the rope entering wedge hole and the rope exiting wedge hole.

7. The wire rope suspension device according to claim 5, wherein the rope entering wedge hole is located at a central position of the first beam.

8. The wire rope suspension device according to claim 1, further comprising an outer bracket, at least partial structures of the first beam, the second beam, the suspension cylinder and the suspension joint being disposed in an inner space of the outer bracket, and a plane bearing being provided between the outer bracket and the first beam, the plane bearing having one surface fixed to the outer bracket and the other surface fixed to the first beam.

9. The wire rope suspension device according to claim 1, further comprising an outer bracket and a joint limiting mechanism, at least partial structures of the first beam, the second beam, the suspension cylinder and the suspension joint being disposed in the inner space of the outer bracket, the joint limiting mechanism being configured to effect switching between a movement restriction state and a movement restriction releasing state of the suspension joint with respect to the outer bracket during operation process.

10. The wire rope suspension device according to claim 9, wherein the joint limiting mechanism comprises a first pin hole and a second pin hole respectively disposed on the outer bracket and the suspension joint, the movement restriction state being effected by inserting a limit pin into the first pin hole and the second pin hole, and the movement restriction releasing state being effected by pulling out the limit pin from the first pin hole and the second pin hole.

11. The wire rope suspension device according to claim 1, wherein the first beam and the second beam are connected by a screw, and the screw is provided with an adjusting nut, for adjusting and fixing a relative position between the first beam and the second beam.

12. The wire rope suspension device according to claim 1, wherein oil chambers on both sides of a piston in the suspension cylinder are provided with oil ports, which are configured to connect a pressure oil source upon performing a rope adjustment operation of the wire rope, such that the suspension cylinder extends to push the second beam to move toward the first beam or retracts to pull the second beam to move away from the first beam.

13. A multi-rope friction lifter, comprising:

a lifting container;

a lifting drive mechanism;

a plurality of wire ropes; and a plurality of wire rope suspension devices according to claim 1, corresponding to the plurality of wire ropes.

14. The multi-rope friction lifter according to claim 13, wherein oil ports on rod chambers of the wire rope suspension devices are communicated with each other through an oil passage, and control valves are respectively provided at the oil ports of the rod chambers, oil ports on rodless chambers of the wire rope suspension devices are also communicated to each other through an oil passage, and control valves are respectively provided at the oil port of the rodless chamber.

15. A control method based on the wire rope suspension device according to claim 1, comprising:

a rope exiting process:

driving the second beam to displace toward the first beam by the suspension cylinder; and driving the wedge joint to move biasedly to a side wall of the accommodating chamber for locking a wire rope section on a first side of the wedge joint and releasing movement restriction of a wire rope section on a second side of the wedge joint by the wire rope bias limiting mechanism, so as to effect rope exiting of the wire rope;

a rope entering process:

driving the second beam to displace oppositely with respect to the first beam by the suspension cylinder; and driving the wedge joint to move biasedly to a side wall of the accommodating chamber for locking the wire rope section on the second side of the wedge joint and releasing movement restriction of the wire rope section on the first side of the wedge joint by the wire rope bias limiting mechanism, so as to effect rope entering of the wire rope.

16. The control method according to claim 15, wherein the wire rope suspension device further comprises an outer bracket and a joint limiting mechanism, at least partial structures of the first beam, the second beam, the suspension cylinder and the suspension joint being disposed in an inner space of the outer bracket, the control method further comprises:

during the rope exiting process, operating the joint limiting mechanism so as to form a movement restriction state between the suspension joint and the outer bracket; and during the rope entering process, operating the joint limiting mechanism so as to form a movement restriction releasing state between the suspension joint and the outer bracket.

17. The control method according to claim 16, wherein the joint limiting mechanism comprises a first pin hole and a second pin hole respectively disposed on the outer bracket and the suspension joint, operation of the joint limiting mechanism comprises:

inserting a limit pin into the first pin hole and the second pin hole to effect the movement restriction state; and pulling out the limit pin from the first pin hole and the second pin hole to effect the movement restriction releasing state.

18. The control method according to claim 15, wherein the first beam and the second beam are connected by a screw with an adjusting nut provided thereon, the control method further comprises:

adjusting the adjusting nut to enable a relative movement between the first beam and the second beam before effecting rope adjustment of the wire rope by driving the second beam to move by the suspension cylinder; and adjusting the adjusting nut so as to maintain a fixed position of the first beam relative to the second beam after completion of rope adjustment of the wire rope.

19. The control method according to claim 15, wherein oil chambers on both sides of a piston in the suspension cylinder are provided with oil ports, the control method further comprises:

before effecting the rope adjustment of the wire rope through driving the second beam to move by the suspension cylinder, connecting the oil ports of the suspension cylinder to a pressure oil source such that the suspension cylinder extends to push the second beam to move toward the first beam or retracts to pull the second beam to move away from the first beam.

* * * * *